US011821283B2

(12) United States Patent
Underbrink et al.

(10) Patent No.: US 11,821,283 B2
(45) Date of Patent: Nov. 21, 2023

(54) PORT FREE HYDRAULIC UNIBODY SYSTEM AND METHODOLOGY FOR USE IN A WELL

(71) Applicant: Schlumberger Technology Corporation, Sugar Land, TX (US)

(72) Inventors: Michael Underbrink, Rosenberg, TX (US); Farhan Ahmed Omer, Guadalupe (MX); Susan Wu, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 66 days.

(21) Appl. No.: 17/597,600

(22) PCT Filed: Jul. 17, 2020

(86) PCT No.: PCT/US2020/042440
§ 371 (c)(1),
(2) Date: Jan. 13, 2022

(87) PCT Pub. No.: WO2021/011838
PCT Pub. Date: Jan. 21, 2021

(65) Prior Publication Data

US 2022/0259941 A1 Aug. 18, 2022

Related U.S. Application Data

(60) Provisional application No. 62/875,849, filed on Jul. 18, 2019.

(51) Int. Cl.
*E21B 33/1295* (2006.01)
*E21B 23/06* (2006.01)

(52) U.S. Cl.
CPC ..... *E21B 33/1295* (2013.01); *E21B 23/06* (2013.01)

(58) Field of Classification Search
CPC ..... E21B 33/1295; E21B 23/06
See application file for complete search history.

(56) References Cited

U.S. PATENT DOCUMENTS 4,044,826 A 8/1977 Crowe
4,296,806 A * 10/1981 Taylor ..... F16J 15/20 277/342

(Continued)

FOREIGN PATENT DOCUMENTS

CN 106988695 A 7/2017

OTHER PUBLICATIONS

International Search Report and Written Opinion issued in PCT/US2020/042440, dated Nov. 2, 2020 (12 pages).

*Primary Examiner* — D. Andrews
(74) *Attorney, Agent, or Firm* — Michael Wills, III

(57) ABSTRACT

A technique facilitates use of a liner hanger in a borehole. A port free hydraulic unibody system including an outer structure having a tubing hanger portion and a packer portion mounted about a mandrel may be constructed so as to avoid the creation of leak paths. A seal system may be employed between the mandrel and the surrounding outer structure to ensure sealing engagement therebetween. The mandrel has a port free section on the downhole side of the seal system, and this port free section is maintained during, for example, actuation of the tubing hanger portion so as to prevent formation of leak paths. An actuator may be located along the mandrel and may be configured to initiate actuation of hanger slips mounted along the tubing hanger portion. An (Continued)

anti-preset mechanism positioned along the mandrel works in cooperation with the actuator to prevent premature actuation of the hanger slips.

19 Claims, 3 Drawing Sheets

(56) References Cited

U.S. PATENT DOCUMENTS

| | | | | |
|---|---|---|---|---|
| 4,311,194 | A | 1/1982 | White | |
| 2005/0006106 | A1 | 1/2005 | Hirth et al. | |
| 2018/0238151 | A1 | 8/2018 | Burke et al. | |
| 2019/0203559 | A1* | 7/2019 | Ezell | E21B 33/1295 |

* cited by examiner

PORT FREE HYDRAULIC UNIBODY SYSTEM AND METHODOLOGY FOR USE IN A WELL

CROSS-REFERENCE TO RELATED APPLICATION

This application is based on and claims priority to U.S. Provisional Application Ser. No. 62/875,849, filed Jul. 18, 2019, which is incorporated herein by reference in its entirety.

BACKGROUND

In many well applications, casing is deployed downhole into a wellbore and cemented in place within the wellbore. Various liners or other types of tubing may be deployed and anchored within the casing via a tubing hanger. The tubing hanger may be combined with a packer to provide a seal between the tubing and the surrounding casing. Additionally, the tubing hanger may comprise slips which are actuated into engagement with the surrounding casing to provide support for the liner or other tubing. The tubing hanger slips are actuated via a piston-based actuation system, but current actuation systems may be subject to occurrence of leak paths.

SUMMARY

In general, a system and methodology are provided for facilitating the use of a liner hanger in a borehole. According to an embodiment, a port free hydraulic unibody system is constructed so as to avoid the creation of leak paths. The port free hydraulic unibody system may comprise an outer structure having a tubing hanger portion and a packer portion mounted about a mandrel. A seal system may be employed between the mandrel and the surrounding outer structure to ensure sealing engagement therebetween. The mandrel has a port free section at least on the downhole side of the seal system and this port free section is maintained on the downhole side of the seal system during, for example, actuation of the tubing hanger portion so as to prevent formation of leak paths. An actuator may be located along the mandrel and may be configured to initiate actuation of hanger slips mounted along the tubing hanger portion. Additionally, an anti-preset mechanism may be positioned along the mandrel so as to work in cooperation with the actuator in preventing premature actuation of the hanger slips.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
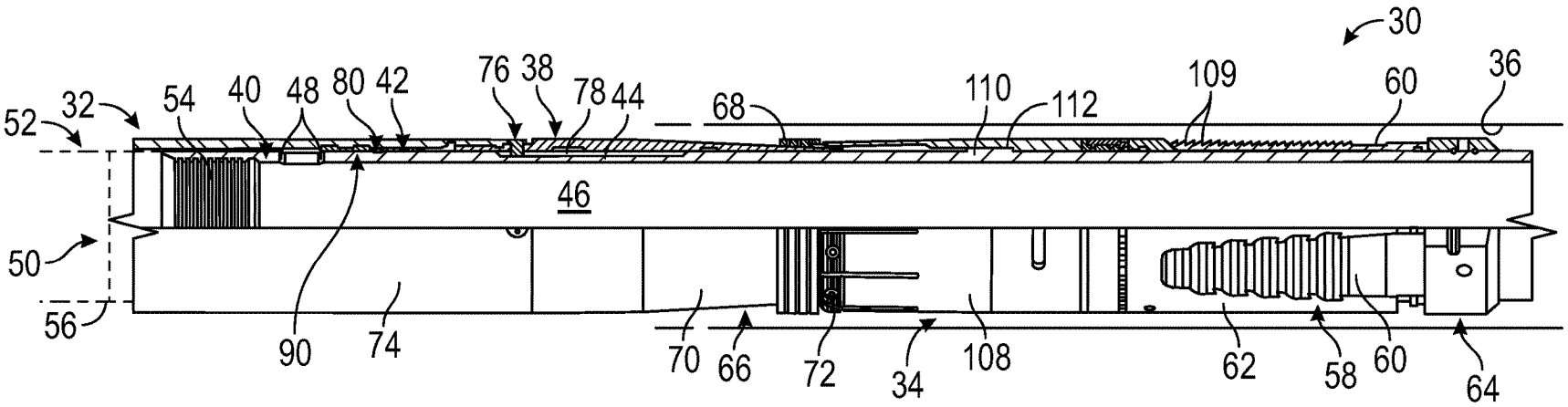
FIG. 1 is a partial cross-sectional illustration of an example of a port free hydraulic unibody system deployed in a surrounding tubular element, e.g. a casing, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating the use of a liner hanger in a borehole. According to an embodiment, a port free hydraulic unibody system is constructed so as to avoid the creation of leak paths. The port free hydraulic unibody system may comprise a hydraulically actuated liner hanger combined with an upper or top packer. In various applications, the liner hanger may be selectively actuated via the application of suitable pressure down through a work string. For example, flow through an internal passage of the work string and port free hydraulic unibody system may be selectively controlled so as to direct the hydraulic pressure to a suitable actuator. In some embodiments, flow through the internal passage may be blocked via, for example, a ball or pack off mechanism to enable the desired pressure increase.

In general, the port free hydraulic unibody system may comprise an outer structure having a tubing hanger portion and a packer portion mounted about a mandrel. A seal structure may be employed between the mandrel and the surrounding outer structure to ensure sealing engagement therebetween. By way of example, the seal structure may be in the form of a seal stack used in combination with a tieback receptacle. The mandrel has a port free section at least on the downhole side of the seal system and this port free section is maintained on the downhole side of the seal system during, for example, actuation of the tubing hanger portion. This unibody construction is a construction which combines both a packer and a hanger in a single body and in a manner which prevents formation of leak paths. In various embodiments, the mandrel may be port free along its entire length. In other words, the mandrel may be generally tubular with a longitudinal internal passage but without lateral ports through the wall of the tubular mandrel.

Additionally, an actuator may be located along the mandrel and may be configured to initiate actuation of hanger slips mounted along the tubing hanger portion. In some embodiments, the actuator may be in the form of a piston, e.g. a circumferential piston generally encircling the mandrel. However, other types of actuators may be used to initiate setting of the hanger slips. An anti-preset mechanism also may be positioned along the mandrel. The anti-preset mechanism works in cooperation with the actuator to prevent premature actuation of the hanger slips during, for example, running in hole. The arrangement of components and the use of a mandrel with no lateral ports (at least below the seal structure) provides an effective port free hydraulic unibody system which avoids potential leak paths present in conventional hanger systems.

Referring generally to FIG. 1, an example of a well system 30 is illustrated. In this embodiment, the well system 30 comprises a port free hydraulic unibody system 32 positioned in a borehole 34, e.g. a wellbore, which may be cased with a casing 36. The port free hydraulic unibody system 32 may comprise an outer structure 38 slidably engaged with an inner mandrel 40 across a seal structure 42. The inner mandrel 40 is illustrated as tubular with a wall 44 forming a longitudinal passage 46 extending therethrough. However, the mandrel 40 has no lateral ports extending through wall 44 at least on the downhole side of seal structure 42. In the illustrated embodiment, the mandrel 40 comprises at least one port 48 located on the uphole side of seal structure 42 although other embodiments of mandrel 40 have no lateral ports through mandrel wall 44 along the entire length of mandrel 40.

The longitudinal passage 46 may be part of an overall passage 50 extending, for example, up through a work string 52. The work string 52 may be coupled with mandrel 40 at a connection end 54, e.g. a threaded connection end. By way of example, the work string 52 may extend up to the surface and may comprise a running tool 56 used to run the port free hydraulic unibody system 32 to a desired downhole location.

Referring again to the example illustrated in FIG. 1, the outer structure 38 comprises a tubing/liner hanger 58 positioned generally along the work string 52. The liner hanger 58 is illustrated as having a plurality of hanger slips 60 in operative engagement with a hanger cone 62. The plurality of hanger slips 60 and the hanger cone 62 are positioned about the mandrel 40. By way of example, the hanger slips 60 may be releasably mounted to a gauge ring 64 secured to mandrel 40. As illustrated, downhole ends of hanger slips 60 may be releasably engaged with a lip or other suitable structure disposed about the gauge ring 64.

The outer structure 38 of port free hydraulic unibody system 32 also may comprise a packer 66 having a packer sealing element 68, e.g. an elastomeric sealing element, and a packer cone 70. The packer cone 70 is positioned to enable expansion of the packer sealing element 68. In some embodiments, the packer 66 also may comprise hold down slips 72. The packer sealing element 68, packer cone 70, and the optional hold down slips 72 may be positioned about the mandrel 40. In the example illustrated, the packer cone 70 may be secured to a tie back receptacle (TBR) 74 via suitable fasteners 76, e.g. lugs. The fasteners/lugs 76 may extend into corresponding slots 78 formed in mandrel 40 so as to prevent relative rotation of at least portions of the outer structure 38 with respect to the inner mandrel 40.

Figure 2:
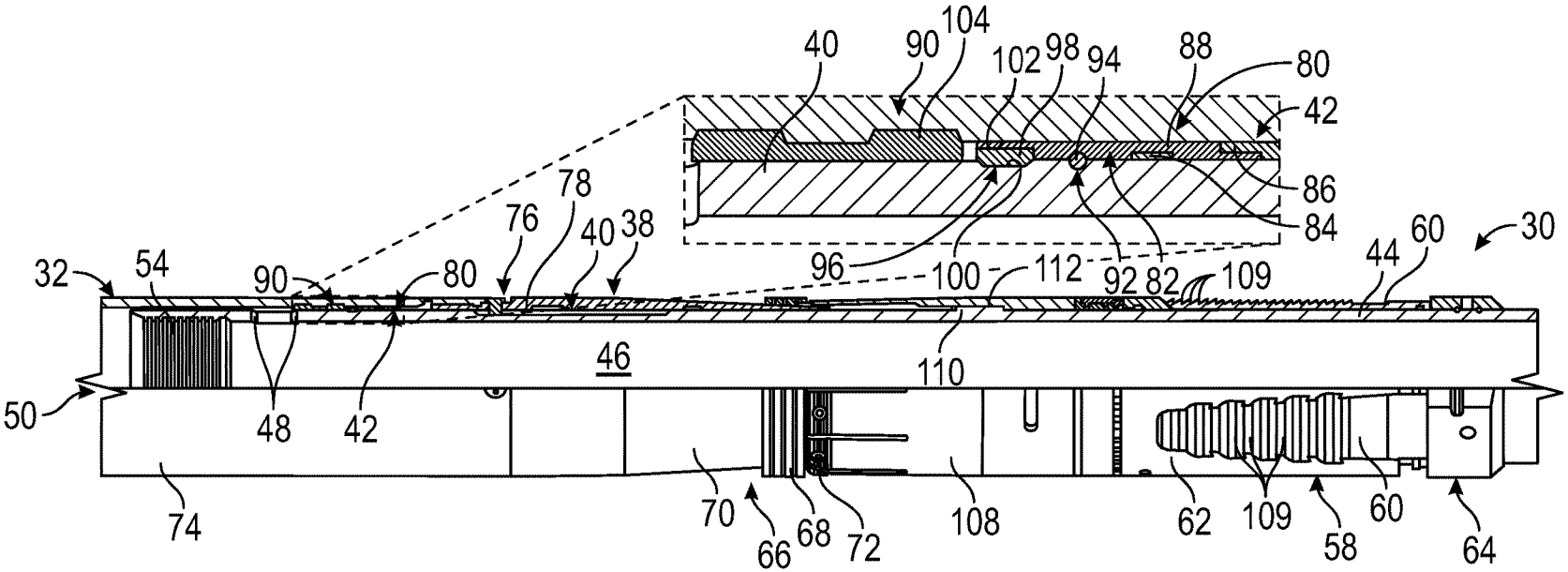
FIG. 2 is a view similar to that shown in FIG. 1 but with an enlarged portion showing an example of an actuator system and an anti-preset mechanism to prevent premature actuation of the port free hydraulic unibody system, according to an embodiment of the disclosure.

With additional reference to FIG. 2, the port free hydraulic unibody system 32 also comprises an actuator system 80 having an actuator 82. The actuator system 80 may be positioned along the mandrel 40 and may be shifted in response to hydraulic pressure, e.g. hydraulic pressure supplied down through the work string 52. The hydraulic actuating pressure may be used to shift the actuator 82 and to thus initiate setting of the plurality of hanger slips 60.

In some embodiments, the actuator system 80 may further integrate seal structure 42. For example, the seal structure 42 may comprise at least one inner seal 84 sealingly positioned between the actuator 82 and the mandrel 40 combined with at least one outer seal 86 positioned between the actuator 82 and a surrounding tubular structure, e.g. tie back receptacle 74. When the surrounding tubular structure comprises tie back receptacle 74, the seal structure 42 may be in the form of a tie back receptacle seal stack providing a seal between the inner mandrel 40 and the tie back receptacle 74. By way of example, the actuator 82 may be in the form of a piston 88, e.g. a circumferential piston encircling the mandrel 40.

According to the embodiment illustrated, the port free hydraulic unibody system 32 further comprises an anti-preset mechanism 90 which may be located along the mandrel 40. The anti-preset mechanism 90 is constructed to prevent premature shifting of the actuator 82, e.g. piston 88, and to thus prevent premature setting of the plurality of hanger slips 60. For example, the anti-preset mechanism 90 is able to prevent premature setting which could otherwise occur due to forces acting on external components during running in hole of the system 32.

Although the anti-preset mechanism 90 may have a variety of configurations and components, an example is illustrated in the enlarged cutout portion of FIG. 2. In this example, the anti-preset mechanism 90 comprises a shear member 92 located between the actuator 82 and the mandrel 40. By way of example, the shear member 92 may be a shear wire 94 captured in corresponding circumferential slots in the actuator 82 and mandrel 40. However, the shear member 92 may be in the form of a shear screw(s), shear ring(s), or other suitable device.

The anti-preset mechanism 90 also may comprise a locking member 96 which holds the actuator 82, e.g. piston 88, in place along the mandrel 40 until the hanger slips 60 are ready for actuation. By way of example, the locking member 96 may be in the form of a snap ring 98, e.g. a snap C-ring, captured in a corresponding mandrel slot 100 and an actuator recess 102. In some embodiments, the anti-preset mechanism 90 also may comprise a lock ring 104, e.g. a tie back receptacle lock ring, which locks into the tie back receptacle 74 and which may bottom out against locking member 96 during, for example, running in hole.

To hydraulically set the liner hanger 58, hydraulic pressure may be supplied down through the work string 52 and directed out to the annulus between mandrel 40 and tied back receptacle 74 via, for example, running tool 56. Flow along the internal longitudinal passage 46 of mandrel 40 may be blocked by dropping a ball 106 down through the overall internal passage 50 until the ball 106 seats against a corresponding ball seat located at a lower end of mandrel 40 or at another suitable location. However, other devices, e.g. pack off mechanisms, may be used to temporarily block fluid flow along internal passages 46, 50. Regardless of the specific device used, temporarily blocking flow along internal passages 46, 50 enables application of sufficient pressure from the surface to hydraulically actuate, e.g. shift, actuator 82.

As hydraulic actuation pressure is increased, the pressure causes actuator 82, e.g. piston 88, to shear the shear member 92 and to shift the actuator 82 until locking member 96, e.g. snap ring 98, is released from mandrel slot 100. Once the locking member 96 is released, the applied hydraulic pressure causes the actuator 82 and the tie back receptacle 74 to move downwardly along the mandrel 40 while the mandrel 40 is held in position by the work string 52.

Figure 3:
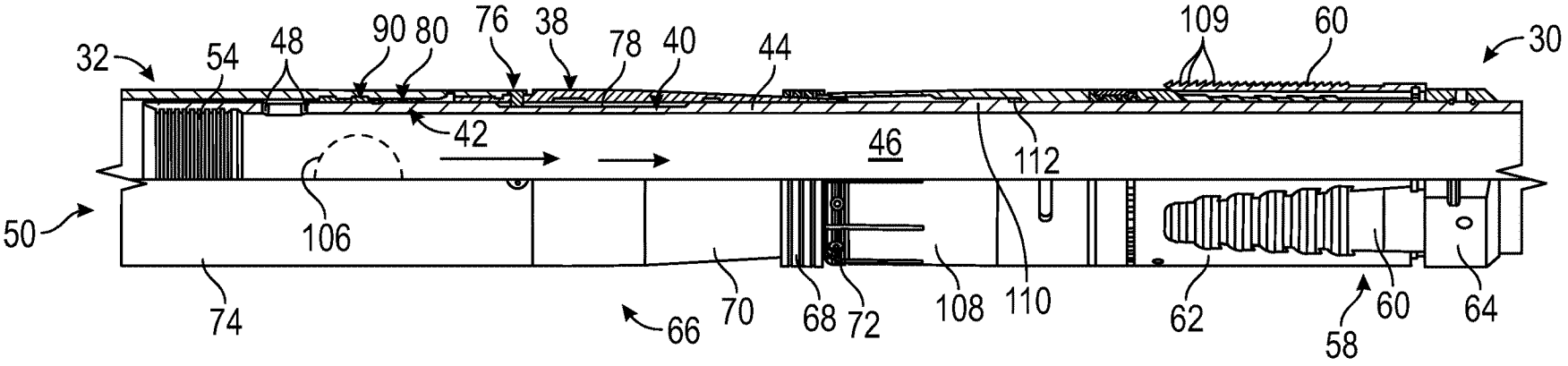
FIG. 3 is a partial cross-sectional illustration of the port free hydraulic unibody system at a stage when setting of the tubing hanger slips is initiated, according to an embodiment of the disclosure.

As the tie back receptacle 74 and the actuator 82 slide along the exterior of mandrel 40, the connected packer cone 70, a corresponding tubular structure 108, and connected hanger cone 62 also are forced to slide downward along the mandrel 40. However, the hanger slips 60 are secured in place with respect to mandrel 40 via gauge ring 64. As a result, the hanger cone 62 slides relative to axially fixed hanger slips 60 and forces the hanger slips 60 in a radially outward direction and into engagement with the casing 36, e.g. the inner surface of casing 36. In some embodiments, this radially outward movement causes the hanger slips 60 to release from the gauge ring 64. This movement initiates the setting of liner hanger 58, as shown in FIG. 3, for example.

Figure 4:
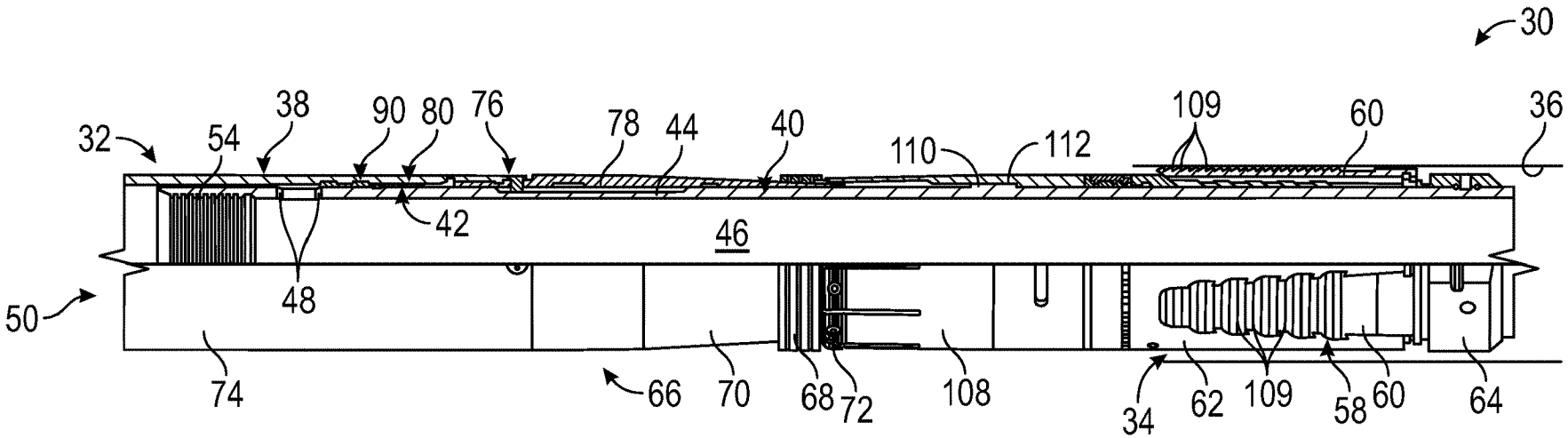
FIG. 4 is a partial cross-sectional illustration of the port free hydraulic unibody system at a stage when weight is slacked off to fully set the tubing hanger, according to an embodiment of the disclosure.

Once the hanger slips 60 engage the casing 36, the liner hanger 58 may be fully set by slacking off weight with respect to the work string 52, as illustrated in FIG. 4. As weight is slacked off the work string 52, the mandrel 40 is allowed to stroke down and transfer weight to the corresponding portion of outer structure 38 which, in turn, causes gripping surfaces 109 of hanger slips 60 to bite further into the casing 36.

In the illustrated example, the mandrel 40 comprises an enlarged outer diameter section 110 which engages a corresponding abutment 112 of corresponding tubular structure 108 when weight is slacked off work string 52. The enlarged outer diameter 110 and the abutment 112 cooperate to transfer weight to the outer structure 38 which further drives hanger cone 62 in a downhole direction with respect to hanger slips 60. As a result, the hanger slips 60 are driven with greater force in a radial direction and into more secure engagement with casing 36.

However, the set down weight may be transferred from mandrel 40 to the corresponding portion of outer structure 38 at a variety of locations and with a variety of mechanisms, e.g. ratchet mechanisms or other suitable mechanisms. In some embodiments, the hanger slips 60 also may be spring-loaded to further help initiate setting of the liner hanger 58.

Figure 5:
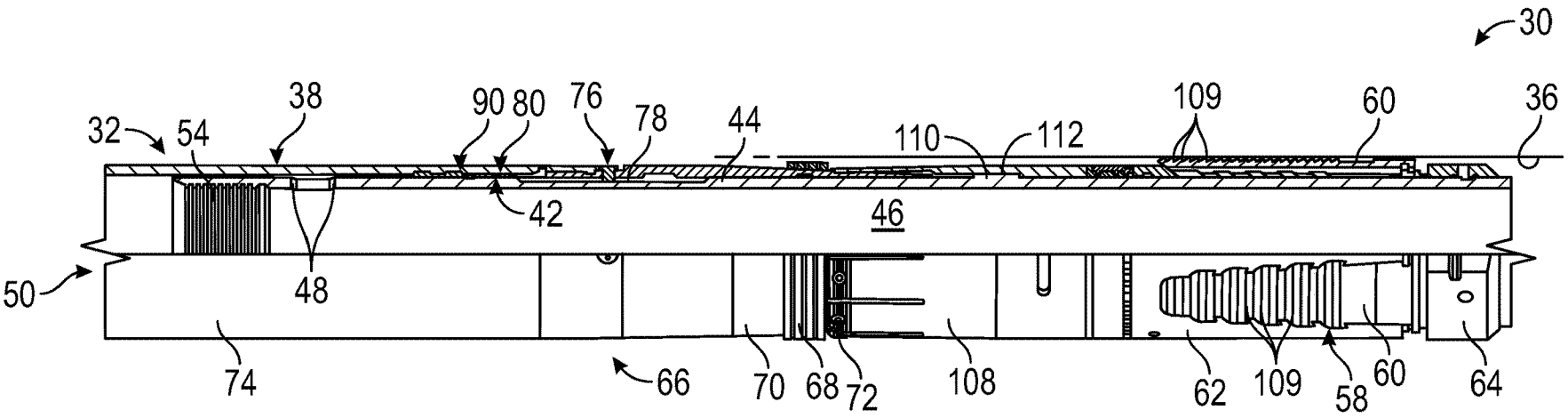
FIG. 5 is a partial cross-sectional illustration of the port free hydraulic unibody system at a stage when both the tubing hanger slips and the packer are set, according to an embodiment of the disclosure.

Referring generally to FIG. 5, the packer 66 may be set via suitable techniques. For example, the packer 66 may be set via a setting tool, e.g. a setting tool which uses a piston to apply load and to thus set packer 66. Various techniques may be used to apply load through the tie back receptacle 74 so as to set packer 66. In some embodiments, the packer 66 may be set by slacking off weight. For example, setting the packer 66 may involve slacking off weight onto the tie back receptacle 74 via a suitable assembly such as a rotating dog assembly. In this type of embodiment, the assembly or other suitable tool may be used to set weight on the tie back receptacle 74 so as to push the packer cone 70 in a downhole direction and through the corresponding packer sealing element 68 and optional packer hold down slips 72. This causes the packer sealing element 68 and the hold down slips 72 to move radially outward until engaging the surrounding casing 36. The engagement with surrounding casing 36 provides a seal along the annulus between the casing 36 and the port free hydraulic unibody system 32. Regardless of the packer setting technique employed, the packer 66 may be set following completion of desired operations, e.g. hanger setting and cementing operations.

It should be noted the port free hydraulic unibody system 32 may be constructed in various sizes and configurations. For example, the liner hanger 58 and the packer 66 may be constructed with different types of suitable components. For example, the liner hanger 58 may utilize a variety of hanger slips and hanger cones. Similarly, the packer 66 may use various types of sealing elements, hold down slips, cones, and/or other components. The actuator system 80 may use a variety of actuators 82 which may comprise different types of pistons 88. However, the actuator system 80 also may utilize actuators 82 in the form of, for example, portions of the tie back receptacle 74, packer cone 70, or other components configured and located to initiate setting of the liner hanger 58. Similarly, the anti-preset mechanism 90 may comprise various types of shear members, lock members, and/or other components to prevent premature shifting of actuator 82 and thus prevent premature setting of liner hanger 58.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a liner hanger positioned along a work string, the liner hanger having a plurality of hanger slips in operative engagement with a hanger cone, the plurality of hanger slips and the hanger cone being positioned about a mandrel;

a packer having a packer sealing element and a packer cone positioned to enable expansion of the packer sealing element, the packer sealing element and the packer cone being positioned about the mandrel;

wherein to enable expansion, the packer cone is pushed through the packer sealing element causing the packer sealing element to move radially outward;

an actuator system having an actuator positioned along the mandrel, the actuator being responsive to hydraulic pressure to initiate setting of the plurality of hanger slips, the actuator system further comprising seals located to provide sealing between the mandrel and a surrounding tubular, the mandrel being port free on a downhole side of the seals to prevent leak paths; and an anti-preset mechanism located along the mandrel to prevent premature shifting of the actuator and to thus prevent premature setting of the plurality of hanger slips.

2. The system as recited in claim 1, wherein the packer further comprises hold down slips positioned about the packer cone.

3. The system as recited in claim 1, wherein the actuator comprises a piston.

4. The system as recited in claim 3, wherein the seals comprise at least one outer seal located between the piston and the surrounding tubing and at least one inner seal located between the piston and the mandrel.

5. The system as recited in claim 1, wherein the anti-preset mechanism comprises a shear member located between the actuator and the mandrel.

6. The system as recited in claim 1, wherein the anti-preset mechanism comprises a snap ring located between the actuator and the mandrel.

7. The system as recited in claim 1, wherein the anti-preset mechanism comprises a lock ring located between the actuator and the surrounding tubular.

8. The system as recited in claim 1, wherein the surrounding tubular comprises a tie back receptacle.

9. The system as recited in claim 8, wherein the actuator is shifted and the anti-preset mechanism is released by applying hydraulic pressure down through the work string and along an annulus between the mandrel and the tie back receptacle.

10. The system as recited in claim 9, wherein an internal passage of the work string is selectively sealed off so that pressure may be increased sufficiently to shift the actuator, thus initiating setting of the plurality of hanger slips.

11. A system, comprising:

a hydraulic unibody hanger system having:

an outer structure slidably engaged with an inner mandrel across a seal structure, the inner mandrel being free of lateral ports on a downhole side of the seal structure, the outer structure comprising a packer and hanger slips, the hanger slips being selectively actuated by an actuator via hydraulic pressure;

an anti-preset mechanism located along the mandrel to prevent premature shifting of the actuator and to thus prevent premature setting of the hanger slips; and wherein the packer comprises a packer sealing element and packer hold down slips which interact with a packer cone during setting of the packer;

wherein the packer cone is pushed through the packer sealing element causing the packer sealing element to move radially outward.

12. The system as recited in claim 11, wherein the mandrel has no lateral ports along its entire length.

13. The system as recited in claim 11, wherein the actuator comprises a piston.

14. The system as recited in claim 13, wherein the piston encircles the mandrel.

15. The system as recited in claim 14, wherein the seal structure comprises at least one seal disposed along an interior of the actuator and at least one seal disposed along an exterior of the actuator.

16. The system as recited in claim 11, wherein the anti-preset mechanism comprises a shear wire located between the actuator and the mandrel; a snap ring located between the actuator and the mandrel; and a lock ring located between the actuator and a surrounding tubular element.

17. The system as recited in claim 11, wherein shifting of the actuator causes relative movement between a hanger cone and the hanger slips so as to bias the hanger slips radially outward into engagement with a surrounding casing.

18. A method, comprising:

providing a port free hydraulic unibody system having a tubing hanger portion and a packer portion mounted about a mandrel in sealing engagement with the mandrel via a seal structure;

wherein the packer portion comprises a packer sealing element which interact with a packer cone during setting of the packer;

wherein the packer cone is pushed through the packer sealing element causing the packer sealing element to move radially outward;

maintaining a port free section of the mandrel on a downhole side of the seal structure to prevent leak paths;

using an actuator located along the mandrel to initiate actuation of hanger slips of the tubing hanger portion; and preventing premature actuation of the hanger slips with an anti-preset mechanism.

19. The method as recited in claim 18, wherein using the actuator comprises using a piston circumferentially disposed about the mandrel.

* * * * *